US005843609A

United States Patent [19]

Borzo et al.

[11] Patent Number: 5,843,609

[45] Date of Patent: Dec. 1, 1998

[54] POLYESTER TONER MICROSPHERES FOR ELECTROPHOTOGRAPHIC IMAGING SYSTEMS

[75] Inventors: Marie Borzo, Basking Ridge; Kophu Chiang, Teaneck; Eui-Won Choe, Randolph; Rao D. Mikkilineni, Warren; Hyun-Nam Yoon, New Providence, all of N.J.

[73] Assignee: Hoechst Celanese Corp., Warren, N.J.

[21] Appl. No.: 923,391

[22] Filed: Sep. 3, 1997

[51] Int. Cl.[6] ..... G03G 9/09

[52] U.S. Cl. ..... 430/106; 430/137

[58] Field of Search ..... 430/106, 109, 430/137

[56] References Cited

U.S. PATENT DOCUMENTS

| | | | |
|---|---|---|---|
| 4,419,430 | 12/1983 | Cooper et al. | 430/109 |
| 5,480,947 | 1/1996 | Oishi et al. | 525/509 |

*Primary Examiner*—John Goodrow
*Attorney, Agent, or Firm*—P. S. Kalyanaraman

[57] ABSTRACT

This invention provides a free-flowing polyester dye microspheric powder which has superior stability and transparency for application in electrophotographic imaging systems. In another embodiment this invention provides a non-aqueous dispersion polymerization process for producing the invention polyester dye microspheric powder. A present invention toner composition comprises polyester dye microspheric powder, and one or more optional ingredients such as a charge control agent or a surfactant.

32 Claims, 2 Drawing Sheets

POLYESTER TONER MICROSPHERES FOR ELECTROPHOTOGRAPHIC IMAGING SYSTEMS

CROSS-REFERENCE TO RELATED APPLICATION

The subject matter of this patent application is related to that disclosed in patent application Ser. No. 08/923,394, filed Sep. 3, 1997; incorporated by reference.

BACKGROUND OF THE INVENTION

This invention generally relates to toner compositions and their utility in electrophotography. More specifically this invention relates to toner compositions having a polymeric polyester dye component for development of latent electrostatic charge patterns.

The formation and development of images on the surface of photoconductive materials by electrostatic means is well known. The basic electrophotographic imaging process (U.S. Pat. No. 2,297,691) involves placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic toner material. The toner will normally be attracted to those areas of the photoreceptor which retain a charge, thereby forming a toner image corresponding to the electrostatic latent image. This developed image may then be transferred to a substrate such as paper. The transferred image subsequently may be permanently affixed to the substrate by heat, pressure, a combination of heat and pressure, or other suitable fixing means such as solvent or overcoating treatment.

Toner and developer compositions including colored developer compositions are in wide use. These compositions normally contain toner particles consisting of resin and colorants, and carrier particles. The colorants usually are selected from cyan dyes or pigments, magenta dyes or pigments, yellow dyes or pigments, and mixtures thereof.

One of the main advantages of selecting organic dyes instead of pigments for color toner compositions resides in the provision of increased color fidelity as the dyes can be molecularly dispersed in the toner resins. To obtain a homogeneous dispersion, it is generally necessary to build into these molecules certain substituents for enhancing their compatibility with the toner resin. Unless the dye molecules are substantially fully compatible with the toner resins, they have a tendency to aggregate over time, especially when subjected to heat, pressure and humidity thereby resulting in a loss of color fidelity. Additionally, the low molecular weight of the dye molecules causes a high lability or mobility of the dye molecules in the toner resin resulting in undesirable bleeding of the dyes.

Of particular interest with respect to the present invention are toner compositions which include a chromophoric resin ingredient. U.S. Pat. No. 3,699,135 describes a polymer dye prepared by the copolymerization of a silane with an anthraquinone containing two aliphatic hydroxyl groups. U.S. Pat. No. 4,375,357 describes water-soluble noncrystalline polymer block colorants composed of an organic polymer backbone with pendant azo chromophoric units.

Other prior art publications which describe polymeric dyes for toner compositions include U.S. Pat. Nos. 3,553,133; 4,645,727; 4,778,742; 5,200,290; 5,212,033; 5,296,325; and 5,437,953; incorporated by reference.

There is continuing interest in the development of new and improved toner compositions for application in electrophotography.

Accordingly, it is an object of this invention to provide a polymeric dye toner composition which has a superior combination of properties for electrophotographic imaging systems.

It is another object of this invention to provide a toner composition comprising polyester dye microspheres which are adapted for sharp image development of latent electrostatic charge patterns in electrophotography.

It is a further object of this invention to provide a non-aqueous dispersion polymerization process for the production of a novel polyester dye composition in the form of microspheres for electrophotographic image development.

Other objects and advantages of the present invention shall become apparent from the accompanying description and examples.

DESCRIPTION OF THE INVENTION

One or more objects of the present invention are accomplished by the provision of a toner composition for electrophotographic imaging systems which comprises polyester dye microspheres having an average particle size between about 3–10 microns, and having between about 0.1–20 mole percent of recurring chromophoric diester monomer units, and having a weight average molecular weight between about 5000–100,000, and exhibiting a glass transition temperature ($T_g$) between about 40°–120° C., and a melt-viscosity between about 200–5500 poises at 150° C.

In another embodiment this invention provides a chromophoric monomer corresponding to the formula:

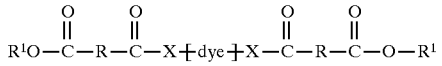

(I)

where X is —O— or —NH—; R is a covalent bond or a divalent $C_1$–$C_{16}$ aliphatic, alicyclic or aromatic radical; and $R^1$ is a $C_1$–$C_6$ aliphatic radical.

The R radical is illustrated by straight or branched-chain alkylene groups such as ethylene, 2-ethylhexylene, octylene and decylene; alicyclic groups such as cyclopentylene and cyclohexylene; aromatic groups such as phenylene, tolylene, xylylene, biphenylene, naphthylene, pyridylene, and the like.

The $R^1$ radical is illustrated by substituents such as methyl, ethyl, propyl, 2-methylpropyl, hydroxyethyl, 3-hydroxy-2-methylpropyl, and the like.

A formula I chromophoric monomer can be prepared by the following type condensation reaction:

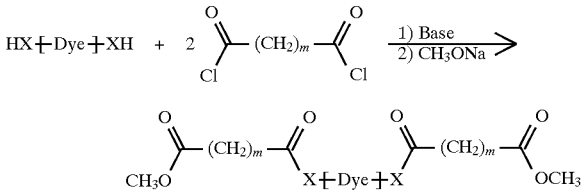

The acyl chloride can be a difunctional reactant such as malonoyl chloride, adipoyl chloride, sebacoyl chloride, isophthaloyl chloride, terephthaloyl chloride, and the like.

Illustrative of formula I chromophoric monomers are bis($C_1$–$C_6$ alkyl sebacamide) of 6'-butoxy-2,6-diamino-3,31-azodipyridine; bis(methyl sebacamide) of 6'-butoxy-2,6-diamino-3,3'azodipyridine; bis($C_1$–$C_6$ alkyl sebacamide) of thionine; bis(methyl sebacamide) of thionine; bis($C_1$–$C_6$ alkyl sebacamide) of basic fuchsin; bis(methyl sebacamide) of basic fuchsin; bis($C_1$–$C_6$ alkyl sebacamide) of 3,6-diaminoacridine hydrochloride; bis(methyl sebacamide) of 3,6-diaminoacridine hydrochloride; bis($C_1$–$C_6$ alkyl sebacate) of 4-(4-nitrophenylazo)resorcinol; bis(methyl sebacate) of 4-(4-nitrophenylazo)-resorcinol; bis($C_1$–$C_6$ alkyl sebacamide) of 2,9-dimethylquinacridone; bis(methyl sebacamide) of 2,9-dimethylquinacridone; bis($C_1$–$C_6$ alkyl sebacamide) of 1,4-bis(ethylamino)-9,10-anthraquinone; bis (methyl sebacamide) of 1,4-bis(ethylamino)-9,10-anthraquinone; bis($C_1$–$C_6$ alkyl sebacamide) of 1,4-bis(n-butylamino)-9,10-anthraquinone; bis(methyl sebacamide) of 1,4-bis(n-butylamino-9,10-anthraquinone; bis($C_1$–$C_6$ alkyl sebacamide) of 1,4-bis(4-methylanilino)-9,10-anthraquinone, bis(methyl sebacamide) of 1,4-bis(4-methylanilino)-9,10-anthraquinone; bis($C_1$–$C_6$ alkyl sebacamide) of 2,3-dihydro-2,2-dimethyl-6-[[4-(phenylazo) -1 -naphthalenyl]azo]-1H-perimidine; bis(methyl sebacamide) of 2,3-dihydro-2,2-dimethyl-6-[[4-(phenylazo) -1-naphthalenyl]azo]-1H-perimidine; and the like.

In another embodiment this invention provides a chromophoric monomer corresponding to the formula:

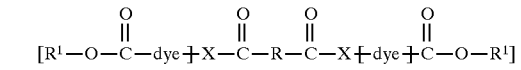

(II)

where X is —O— or —NH—; and R is a covalent bond or a divalent $C_1$–$C_{16}$ aliphatic, alicyclic or aromatic radical; and $R^1$ is a $C_1$–$C_6$ aliphatic radical.

The R and $R^1$ radicals in formula II can be similar to those illustrated for formula I monomers. A similar type of reaction can be employed for formula II monomer synthesis, such as the condensation of sebacoyl chloride and methyl eosin to produce bis(methyl eosin) sebacate.

In another embodiment this invention provides monomeric diols which can copolymerize with a formula I or formula II chromophoric monomer to form a polyester dye for toner compositions. The invention monomeric diols correspond to one of the formulas:

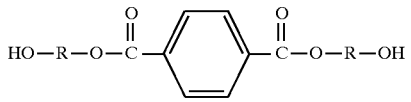

(III)

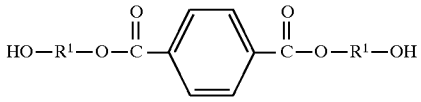

(IV)

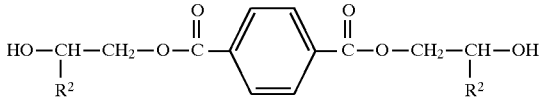

(V)

where R is normal or branched-chain $C_3$–$C_{30}$ alkylene; $R^1$ is normal or branched-chain $C_8$–$C_{30}$ alkylene; and $R^2$ is normal $C_6$–$C_{28}$ alkyl.

Illustrative of formulas III-V monomeric diols are bis(3-hydroxy-2-methylpropyl) terephthalate; bis(2-tetradecyl-2-hydroxyethyl) terephthalate; bis(2-hexyl-2-hydroxyethyl) terephthalate; and the like.

An important aspect of the present invention is the provision of a toner composition which has a superior combination of physicochemical properties for application in electrophotographic imaging systems.

A toner composition of the present invention comprises, as a main component, a polyester dye in microspheric form having between about 0.1–20 mole percent of recurring chromophoric diester monomer units, and having a weight average molecular weight between about 5000–100,000, and exhibiting a glass transition temperature ($T_g$) between about 40°–120° C., and a melt-viscosity between about 200–5500 poises at 150° C.

In a preferred toner composition the polyester dye has a weight average molecular weight between about 10,000–30,000, and/or the toner composition has a polydispersity between about 1.2–4, and/or exhibits a melt index between about 25–1000 grams per 10 minutes at 150° C. under a load of 2.16 kilograms, and/or exhibits at least 80% optical transparency at a specific wavelength within the range between about 350–750 nanometers.

The chromophoric entity in a present invention monomer or polyester dye is selected from organic structures which include yellow 6'-butoxy-2,6-diamino-3,3'-azodipyridine; blue thionine; red basic fuchsin; magenta; 3,6-diaminoacridine hydrochloride; red methyl eosin; yellow 4-(4-nitrophenylazo)resorcinol; magenta 2,9-dimethylquinacridine; yellow 2,2'-[(3,3'-dichloro-1,1'-diphenyl)-4,4'-bis(azo)]-bis[N-(2 -methoxyphenyl)]-3-oxobutanamide; cyan 1,4-bis(ethylamino)-9,10-anthraquinone; cyan 1,4-bis(n-butylamino)-9,10-anthraquinone; cyan 1,4-bis(4-methylanilino)-9,10-anthraquinone; black 2,3-dihydro-2,2-dimethyl-6-[[(4-phenylazo)-1-naphthylenyl]-azo]-1H-perimidine; and the like. A selected chromophoric structure has the requisite difunctionality to convert to a chromophoric monomer in accordance with the present invention.

In another embodiment this invention provides a process for producing a toner composition which comprises polyester dye microspheres having an average particle size between about 3–10 microns, and having between about 0.1–20 mole percent of recurring chromophoric diester monomer units, and having a weight average molecular weight between about 5000–100,000, and exhibiting a glass transition temperature ($T_g$) between about 40°–120° C., and a melt-viscosity between about 200–5500 poises at 150° C., which process comprises copolymerizing a dispersed insoluble phase of diol monomer and chromophoric diester monomer in a liquid organic medium in the presence of a nonionic surfactant at a temperature between about 100°–280° C. with high shear mixing and with distilling of interchanged alcohol, and separating the formed polyester dye microspheres from the liquid organic medium.

The types of diol monomers and chromophoric diester monomers previously described are utilized as co-reactants in the invention dispersion polymerization process.

The term "organic medium" as employed herein refers to a thermally-stable chemically-inert fluid medium that typically is an organic solvent which has a higher boiling point than the temperature of a polymerization reaction in progress, and in which the monomers and the polyester dye microspheres are essentially insoluble.

Suitable liquid organic media include normal paraffins, branched-chain paraffins, naphthenes, aromatic hydrocarbons, and oxygenated derivatives thereof. High boiling solvent media are commercially available under tradenames such as Norpar, Isopar, Varsol, Solvesso and Exxate (Exxon); Whitemor and Puremor (Castrol); and Pallidex (Shell).

A product such as Norpar 15 is a n-paraffin mixture which has a boiling range of 245°–285° C. Other suitable organic solvents such as biphenyl and diphenyl oxide are described in publications such as European Patent Application 0 275 163, incorporated by reference.

A nonionic surfactant ingredient is included in the invention polymerization process to aid in the formation and stabilization of a dispersed phase of finely divided monomer particles.

Suitable nonionic surfactants include compounds produced by the condensation of alkylene oxide groups with an organic hydrophobic compound, such as the polyethylene oxides of alkylphenols.

A commercial nonionic ethoxylated alcohol product such as Neodol 23-3 (Shell) is composed of a liquid mixture of $C_{12}$–$C_{13}$ alcohols which have an average content of three ethoxylate groups per alcohol molecule. A commercial nonionic ethoxylated alcohol product such as Neodol 23-3 typically has a content of up to about 20 weight percent of unethoxylated alcohols such as $C_{12}$–$C_{13}$ alcohols. Nominally 24-3 refers to a mixture of $C_{12}$–$C_{14}$ alcohols which have an average content of three ethoxylate groups per alcohol molecule.

Other suitable nonionic surfactants are described in publications such as U.S. Pat. No. 5,565,422, incorporated by reference. A preferred type of nonionic surfactant for the invention polymerization process is an organic polymer which can function as a dispersing agent, such as Ganex V-220 (ISP Technologies Inc.). Ganex V-220 is a copolymer of vinylpyrrolidone and 1-eicosene (MW of 8600), which has a MP of 32°–36° C. This type of polymeric nonionic surfactant tends to have a compatible interface with the fluid organic medium, which is advantageous for purposes of effective dispersing activity.

The present invention polymerization process for production of polyester dye microspheres is conducted at a temperature between about 100°–280° C. for a reaction period sufficient to achieve the desired degree of polymerization, e.g., a reaction period between about 0.5–5 hours. During the polymerization reaction, alcoholysis releases an alcohol byproduct, which preferably is removed continuously by distillation. The polymerization can include an organic solvent component which functions as an azeotroping agent for distillation of the interchanged alcohol byproduct. Removal of the alcohol byproduct shifts the reaction equilibrium in favor of polyester dye formation.

An important aspect of the present invention polymerization process is the input of high shear mixing action, typically by means of a stirrer operating at a speed between about 500–10,000 rpm. There is a direct correlation between the high shear mixing activity and the average particle size of the monomer dispersion phase in the liquid organic medium. The size and shape of the suspended monomer particles determine the size and shape of the final polyester dye particles, i.e., the desired microspheres having a preferred average particle size between about 3–10 microns.

The polyester dye product of the dispersion polymerization process is recovered in the form of a free-flowing powder, which constitutes the main ingredient of an invention toner composition for electrophotographic imaging systems.

A present invention toner composition can include between about 0.001–2 weight percent of a charge control agent for the purpose of imparting a positive charge to toner composition microspheres. Suitable charge control agents include carboxylated salts such as zinc heptanoate and aluminum 2-ethylhexanoate; lecithin; polyisobutylene succinimide; cetyl pyridinium chloride; and charge control agents disclosed in publications such as U.S. Pat Nos. 5,200,290 and 5,296,325; incorporated by reference.

A present invention toner composition can include between about 0.1–10 weight percent of a surfactant ingredient to stabilize the toner composition microspheres. A preferred surfactant is a polymeric type as described in U.S. Pat. No. 5,200,290, such as chlorinated polypropylene and poly(ethylene-vinyl acetate).

A present invention toner composition can include between about 0.5–15 weight percent of a wax ingredient, as illustrated by beeswax, paraffin wax, montan wax, carnauba wax, microcrystalline wax, fatty alcohols, fatty esters, and the like.

A present invention toner composition also can include between about 1–30 weight percent of a particulate co-host resin such as styrene/methacrylate copolymer, styrene/butadiene copolymer, pentaerythritol terephthalate polyester, and the like, which is interspersed with the polyester dye microspheres.

A present invention toner composition has superior properties for purposes of electrophotographic imaging systems. An invention toner composition is a free-flowing powder which is a stable dispersion having a long shelf and storage life. Desirable print density and sharpness, and excellent color quality, can be achieved in electrostatic image development with an invention toner composition.

Excellent print density and color fidelity are attributable to the size and shape of the polyester dye microspheric particles, and the ability of the particles to form a densely packed matrix.

An invention polyester dye also is characterized by a unique combination of glass transition temperature, melt-viscosity and melt index properties which facilitate transfer and fixing of developed electrostatic images to paper substrates.

The following examples are further illustrative of the present invention. The components and specific ingredients are presented as being typical, and various modifications can be derived in view of the foregoing disclosure within the scope of the invention.

EXAMPLE I

Bis(3-hydroxy-2-methylpropyl) Terephthalate

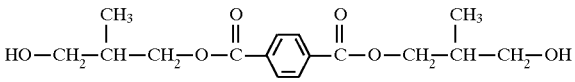

Figure 1:
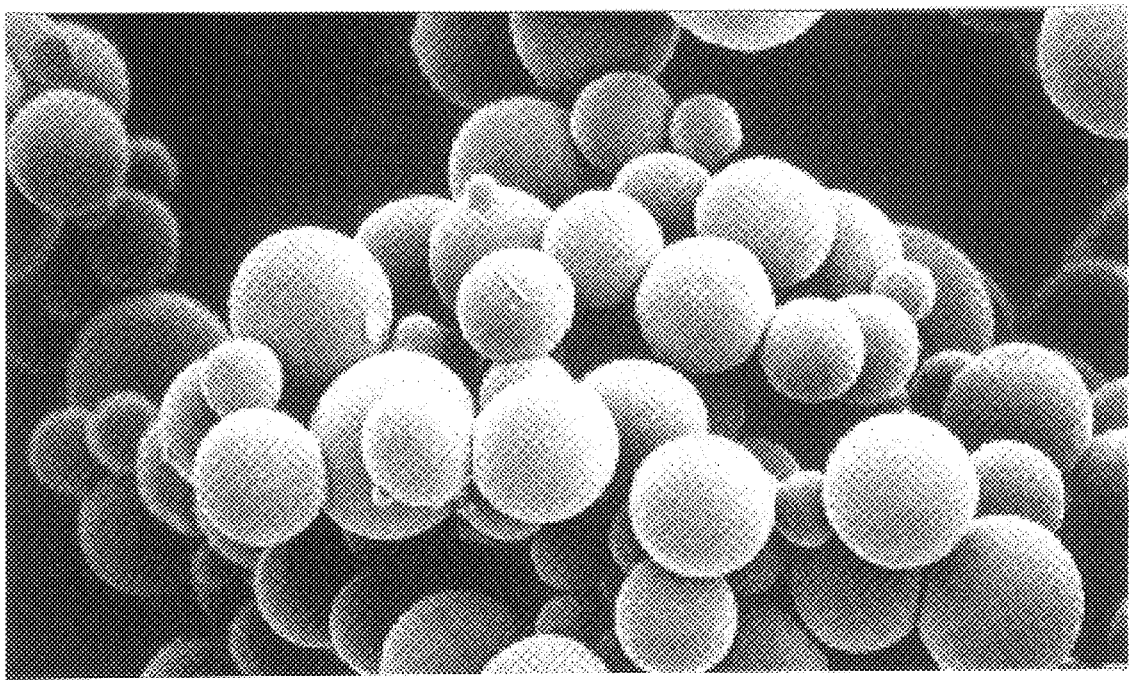
FIG. 1 is a scanning electron microscope (SEM) micrograph of polyester microspheres produced by the Example VI process.

In a 2 liter three-necked flask equipped with nitrogen inlet and outlet, thermometer, condenser and mechanical stirrer, are placed 776.1 grams (4 m) of dimethyl terephthalate, 828 grams (9.2 m) of 2-methyl-1,3-propanediol and 0.6936 grams of titanium tetraisopropoxide. The mixture is heated at 210° C. for 2.5 hours while distilling out methanol. The reaction temperature is raised to 250° C., and excess 2-methyl-1,3-propanediol is distilled off. The resulting product is cooled to room temperature, and recrystallized from methanol to provide 1091 grams of terephthalate diol monomer.

EXAMPLE II

Bis(2-tetradecyl-2-hydroxyethyl) Terephthalate

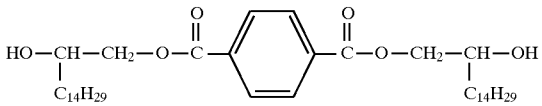

In a one liter three-necked resin flask equipped with nitrogen inlet and outlet, thermometer, condenser and mechanical stirrer, are placed 97.1 grams (0.5 m) of dimethyl terephthalate, 258.45 grams (1 m) of 1,2-hexadecanediol and 0.0865 grams of titanium tetraisopropoxide. The mixture is heated at 210° C. for 2.5 hours while distilling out methanol. The reaction temperature is raised and held at 250° C. for 0.5 hour. The resulting product is cooled to room temperature to provide a quantitative yield of terephthalate diol.

In a similar manner, 1,2-octanediol is employed as a reactant to obtain bis(2-hexyl-2-hydroxyethyl) terephthalate.

EXAMPLE III

Polyester Microspheres of Copolymerized bis(3-hydroxy-2-methylpropyl) Terephthalate and bis (hydroxyethyl) Terephthalate by Non-Aqueous Dispersion Polymerization (NAD)

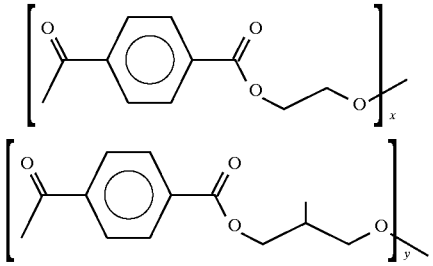

where x/y is 85/15 mole percent.

In a 2 liter three-necked resin flask equipped with nitrogen inlet and outlet, thermometer, condenser and mechanical dispersing stirrer, are placed 37.51 grams (0.122 m) of bis(3-hydroxy-2-methylpropyl) terephthalate, 165.91 grams (0.686 m) of bis(hydroxyethyl) terephthalate, 125 grams of Isopar V[(1)], 375 grams of Norpar 15[(2)], 20.34 grams of Ganex V-200[(3)], and 0.0614 grams of antimony trioxide. The resulting mixture gradually forms a milky white dispersion. After distilling 20 ml of ethylene glycol and 2-methyl-1,3-propanediol, the reaction temperature is increased to 266° C., and maintained at that temperature for 3 hours. The resulting polymer medium is cooled to 35° C. with agitation. The speed of agitation is maintained at 1000 rpm during the polymerization period. The microspheres of polymer are separated from the reaction media by filtration, and washed with hexane. The average particle size of the microspheres is about 10 microns as determined by a JSF-840F Field Emission Scanning Electron Microscope (FESEM, Jeol Corp.) operating at 5 KV.

(1) isoparaffins; Exxon. (2) n-paraffins; Exxon. (3) vinylpyrrolidone/1-eicosene copolymer;

ISP Technologies Inc.

The polyester has a weight average molecular weight of about 14,000, a glass transition temperature of 74° C., a melt-viscosity of 725 poises at 150° C., a melt index of 190 grams per 10 minutes under a load of 2.16 kilograms, and a polydispersity of about 2.5.

Following the dispersion polymerization procedure described above with a reaction temperature of 220° C. for 2 hours, similar polyester dye microspheres are obtained when a chromophoric monomer is included as a reactant, where the x/y/z molar ratio is 84.5/15/0.5, and z is one of the following monomers, respectively:

bis(methyl sebacamide) of 6'-butoxy-2,6-diamino-3,3'-azodipyridine;

bis(methyl sebacamide) of thionine;

bis(methyl sebacamide) of basic fuchsin;

bis(methyl sebacamide of 3,6-diaminoacridine hydrochloride;

bis(methyl sebacate) of 4-(4-nitrophenylazo) resorcinol;

bis(methyl sebacamide) of 2,9-dimethyl-quinacridone;

bis(methyl sebacamide) of 1,4-bis(ethylamino)-9 ,10-anthraquinone;

bis(methyl sebacamide) of 1,4-bis-(n-butylamino)-9,10-anthraquinone;

bis(methyl sebacamide) of 1,4-bis(4-methyl-anilino)-9, 10-anthraquinone; and bis(methyl sebacamide) of 2,3-dihydro-2,2-dimethyl-6-[[4-(phenylazo)-1-naphthylenyl]azo]-1H-perimidine.

EXAMPLE IV

Polyester Microspheres of Copolymerized bis(3-hydroxy-2-methylpropyl) Terephthalate and bis (hydroxyethyl) Terephthalate by Non-Aqueous Dispersion Polymerization (NAD)

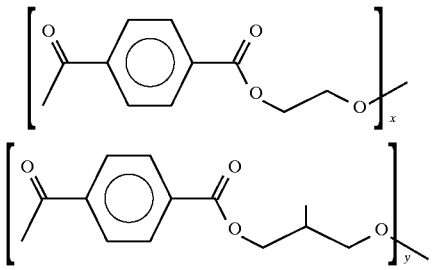

where x/y is 70/30 mole percent.

In a 2 liter three-necked resin flask equipped with nitrogen inlet and outlet, thermometer, condenser and mechanical dispersing stirrer, are placed 75.01 grams (0.242 m) of bis(3-hydroxy-2-methylpropyl) terephthalate, 136.64 grams (0.565 m) of bis(hydroxyethyl) terephthalate, 125 grams of Isopar V, 375 grams of Norpar 15, 21.165 grams of Ganex V-200, and 0.0506 grams of antimony trioxide. The resulting mixture is heated at 240° C. with agitation, while recovering ethylene glycol and 2-methyl-1,3-propanediol distillate. The reaction mixture gradually forms a milky white dispersion. After distilling 20 ml of ethylene glycol and 2-methyl-1,3-propanediol, the reaction temperature is increased to 266° C., and maintained at that temperature for 3 hours. The resulting polymer medium is cooled to 35° C. with agitation. The speed of agitation is maintained at 1000 rpm during the polymerization period. The microspheres of polymer are separated from the reaction media by filtration, and washed with hexane. The average particle size of the microspheres is about 10 microns as determined by a JSM840F FESEM operating at 5 KV.

The polyester has a weight average molecular weight of about 13,000, a glass transition temperature of 64° C., a melt-viscosity of 695 poises at 150° C., a melt index of 200 grams per 10 minutes under a load of 2.16 kilograms, and a polydispersity of about 2.5.

Following the dispersion polymerization procedure described above with a reaction temperature of 220° C. for 2 hours, similar polyester dye microspheres are obtained when a chromophoric monomer as listed in Example III is included, and the x/y/z molar ratio is 69/30/1.

EXAMPLE V

Polyester Microspheres of Copolymerized bis(3-hydroxy-2-methylpropyl) Terephthalate and bis (hydroxyethyl) Terephthalate by Non-Aqueous Dispersion Polymerization (NAD)

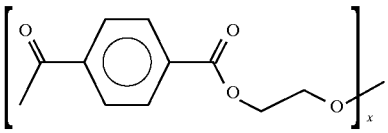

-continued

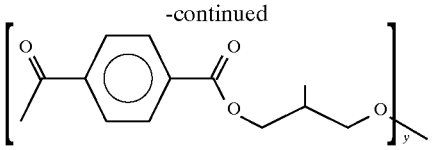

where x/y is 60/40 mole percent.

In a 2 liter three-necked flask equipped with nitrogen inlet and outlet, thermometer, condenser and mechanical dispersing stirrer, are placed 100.02 grams (0.323 m) of bis(3-hydroxy-2-methylpropyl) terephthalate, 117.12 grams (0.484 m) of bis(hydroxyethyl) terephthalate, 125 grams of Isopar V, 375 grams of Norpar 15, 21.71 grams of Ganex V-200, and 0.0433 grams of antimony trioxide. The resulting mixture is heated to 240° C. with agitation, while recovering ethylene glycol and 2-methyl-1,3-propanediol distillate. The reaction mixture gradually forms a milky white dispersion. After distilling 20 ml of ethylene glycol and 2-methyl-1,3-propanediol, the reaction temperature is increased to 266° C. and maintained at that temperature for 3 hours. The resulting polymer medium is cooled to 35° C. with agitation. The speed of agitation is maintained at 1000 rpm during the polymerization period. The microspheres of polymer are separated from the reaction media by filtration, and washed with hexane. The average particle size of the microspheres is about 10 microns as determined by a JSM840F FESEM operating at 5 KV.

The polyester has a weight average molecular weight of about 16,000, a glass transition temperature of 67° C., a melt-viscosity of 800 poises at 150° C., a melt index of 180 grams per 10 minutes under a load of 2.16 kilograms, and a polydispersity of about 2.4.

Following the dispersion polymerization procedure described above with a reaction temperature of 220° C. for 2 hours, similar polyester dye microspheres are obtained when a chromophoric monomer as listed in Example III is included, and the x/y/z molar ratio is 58/40/2.

EXAMPLE VI

Polyester Microspheres of Copolymerized bis(3-hydroxy-2-methylpropyl) Terephthalate and bis (hydroxyethyl) Terephthalate by Non-Aqueous Dispersion Polymerization (NAD)

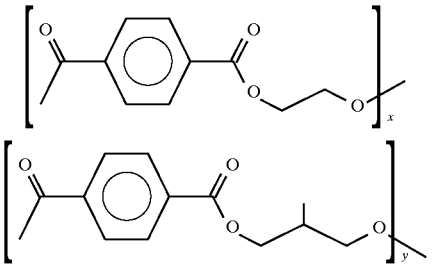

where x/y is 50/50 mole percent.

In a 2 liter three-necked resin flask equipped with nitrogen inlet and outlet, thermometer, condenser and mechanical dispersing stirrer, are placed 125.02 grams (0.403 m) of bis(3-hydroxy-2-methylpropyl) terephthalate, 97.60 grams (0.403 m) of bis(hydroxyethyl) terephthalate, 125 grams of Isopar V, 375 grams of Norpar 15, 22.26 grams of Ganex V-200, and 0.0362 grams of antimony trioxide. The resulting mixture is heated to 240° C. with agitation, while recovering ethylene glycol and 2-methyl-1,3 -propanediol distillate. The reaction mixture gradually forms a milky white dispersion. After distilling 20 ml of a mixture of ethylene glycol and 2-methyl-1,3-propanediol, the reaction temperature is increased to 266° C. and maintained at that temperature for 3 hours. The resulting polymer medium is cooled to 35° C. with agitation. The speed of agitation is maintained at 1000 rpm during the polymerization period. The microspheres of polymer are separated from the reaction media by filtration. The microspheres are washed with hexane. The particle size and particle distribution of the microspheres are Dn±σn 5±2.2 μm and Dv 7.1 μm with C.V. (σn/Dn) 0.42 as determined by a JSM840F FESEM operating at 5 KV. The comparative particle size data for Canon magenta toner is Dn±σn 7.2±2.7 μm, Dv 10.1 μm with C.V. (σn/Dn) 0.38.

The polyester has a weight average molecular weight of about 15,000, a glass transition temperature of 64° C., a melt-viscosity of 750 poises at 150° C., a melt index of 185 grams per 10 minutes under a load of 2.16 kilograms, and a polydispersity of about 2.3.

FIG. 1 is a SEM micrograph of the Example VI polyester microspheres.

Following the dispersion polymerization procedure described above with a reaction temperature of 220° C. for 2 hours, similar polyester dye microspheres are obtained when a chromophoric monomer as listed in Example III is included, and the x/y/z molar ratio is 47/50/3.

EXAMPLE VII

Polyester Microspheres of Copolymerized bis[(3-hydroxy-2-methylpropyl) Terephthalate and bis (hydroxyethyl) Terephthalate by Non-Aqueous Dispersion Polymerization (NAD)

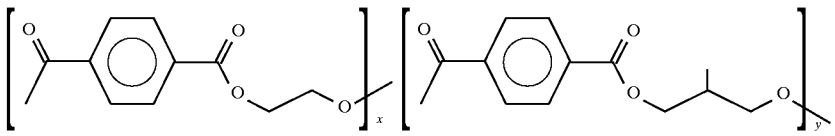

where x/y is 40/60 mole percent.

In a 2 liter three-necked resin flask equipped with nitrogen inlet and outlet, thermometer, condenser and mechanical stirrer, are placed 150.03 grams (0.484 m) of bis(3-hydroxy-2-methylpropyl) terephthalate, 78.08 grams (0.323 m) of bis(hydroxyethyl) terephthalate, 125 grams of Isopar V, 375 grams of Norpar 15, 22.81 grams of Ganex V-200, and 0.0289 grams of antimony trioxide. The resulting mixture is heated to 240° C. with agitation, while recovering ethylene glycol and 2-methyl-1,3-propanediol distillate. The reaction mixture gradually forms a milky white dispersion. After distilling 20 ml of a mixture of ethylene glycol and 2-methyl-1,3-propanediol, the reaction temperature is increased to 266° C. and maintained at that temperature for 3 hours. The resulting polymer medium is cooled to 35° C. with agitation. The speed of agitation is maintained at 1000 rpm during the polymerization period. The microspheres of polymer are separated from the reaction media by filtration. The microspheres are washed with chilled hexane. The average particle size of the microspheres is about 10 microns as determined by a JSM840F FESEM operating at 5 KV.

The polyester has a weight average molecular weight of about 14,000, a glass transition temperature of 61° C., a melt-viscosity of 710 poises at 150° C., a melt index of 185 grams per 10 minutes under a load of 2.16 kilograms, and a polydispersity of about 2.3.

Following the dispersion polymerization procedure described above with a reaction temperature of 220° C. for 2 hours, similar polyester dye microspheres are obtained when a chromophoric monomer as listed in Example III is included, and the x/y/z molar ratio is 40/56/4.

EXAMPLE VIII

Polyester Microspheres of Copolymerized bis[(3-hydroxy-2-methylpropyl) Terephthalate and bis (hydroxyethyl) Terephthalate by Non-Aqueous Dispersion Polymerization (NAD)

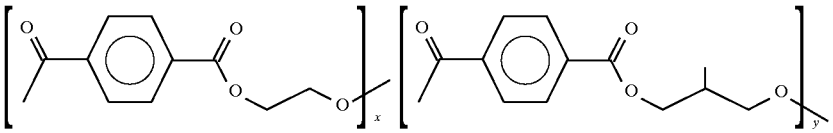

where x/y is 30/70 mole percent.

In a 2 liter three-necked resin flask equipped with nitrogen inlet and outlet, thermometer, condenser and mechanical dispersing stirrer, are placed 175.01 grams (0.565 m) of bis (3-hydroxy-2-methylpropyl ) terephthalate, 58.55 grams (0.242 m) of bis(hydroxyethyl) terephthalate, 125 grams of Isopar V, 375 grams of Norpar 15, 23.37 grams of Ganex V-200, and 0.0217 grams of antimony trioxide. The resulting mixture is heated to 240° C. with agitation, while recovering ethylene glycol and 2-methyl-1,3 -propanediol distillate. The reaction mixture gradually forms a milky white dispersion. After distilling 20 ml of a mixture of ethylene glycol and 2-methyl-1,3-propanediol, the reaction temperature is increased to 266° C. and maintained at that temperature for 3 hours. The resulting polymer medium is cooled to 35° C. with agitation. The speed of agitation is maintained at 1000 rpm during the polymerization period. The microspheres of polymer are separated from the reaction media by filtration. The microspheres are washed with chilled hexane. The average particle size of the microspheres is about 10 microns as determined by a JSM840F FESEM operating at 5 KV.

The polyester has a weight average molecular weight of about 15,000, a glass transition temperature of 58° C., a melt-viscosity of 750 poises at 150° C., a melt index of 185 grams per 10 minutes under a load of 2.16 kilograms, and a polydispersity of about 2.7.

Following the dispersion polymerization procedure described above with a reaction temperature of 220° C. for 2 hours, similar polyester dye microspheres are obtained when a chromophoric monomer as listed in Example III is included, and the x/y/z molar ratio is 30/65/5.

EXAMPLE IX

Polyester Microspheres of Polymerized bis(3-hydroxy-2-methylpropyl) Terephthalate by Non-Aqueous Dispersion Polymerization

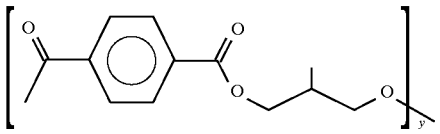

In a 2 liter three-necked resin flask equipped with nitrogen inlet and outlet, thermometer, condenser and mechanical dispersing stirrer, were placed 250 grams (0.806 m) of bis (3-hydroxy-2-methylpropyl) terephthalate, 125 grams of Isopar V, 375 grams of Norpar 15, and 25 grams of Ganex V-200. The resulting mixture is heated to 240° C. with agitation, while recovering 2-methyl-1,3-propanediol distillate. The reaction mixture gradually forms a milky white dispersion. After distilling 20 ml of 2-methyl-1,3-propanediol, the reaction temperature is increased to 266° C. and maintained at that temperature for 3 hours. The resulting polymer medium is cooled to 35° C. with agitation. The speed of agitation is maintained at 1000 rpm during the polymerization period. The microspheres of polymer are separated from the reaction media by filtration. The polymer particles are washed with chilled hexane. The average particle size of the microspheres is about 10 microns as determined by a JSM840F FESEM operating at 5 KV.

The polyester has a weight average molecular weight of about 16,000, a glass transition temperature of 52° C., a melt-viscosity of 750 poises at 150° C., a melt index of 185 grams per 10 minutes under a load of 2.16 kilograms, and a polydispersity of about 2.6.

Following the dispersion polymerization procedure described above with a reaction temperature of 220° C. for 2 hours, similar polyester dye microspheres are obtained when a chromophoric monomer as listed in Example III is included, and the y/z molar ratio is 90/10.

EXAMPLE X

Polyester Microspheres of Copolymerized bis(3-hydroxy-2-methylpropyl) Terephthalate, bis(hydroxyethyl) Terephthalate, bis(2-tetradecyl-2-hydroxyethyl) Terephthalate and bis(methyl sebacamide) of 2,9-dimethylquinacridone by Non-Aqueous Dispersion Polymerization

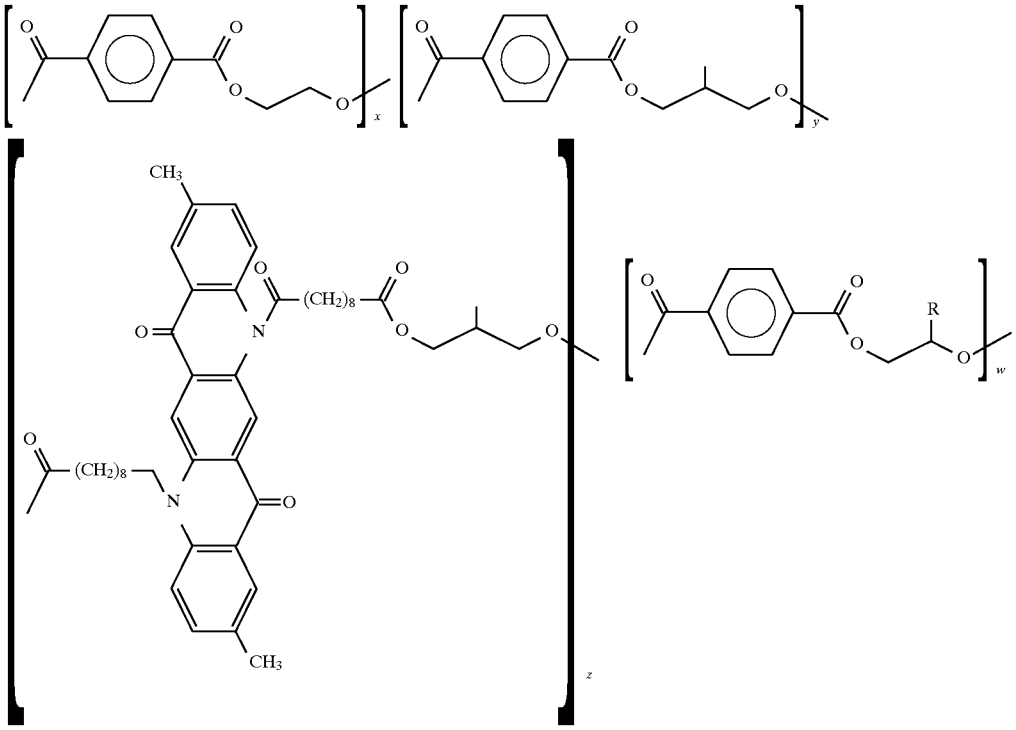

where R is $C_{14}H_{29}$, and x/y/z/w is 68.18/29.22/1.8/0.8 mole percent.

In a one liter three-necked resin flask equipped with nitrogen inlet and outlet, thermometer, condenser and mechanical stirrer, are placed 119.17 grams (0.3840 m) of bis(3-hydroxy-2-methylpropyl) terephthalate, 227.93 grams (0.8964 m) of bis(hydroxyethyl) terephthalate, and 17.83 grams (0.0242) of bis(methyl sebacamide) of 2,9-dimethylquinacridone, 11.54 grams of ethylene glycol, 6.99 grams (0.0108 m) of bis(1-tetradecyl-1-hydroxyethyl) terephthalate, and 0.2 grams of titanium tetraisopropoxide. The resulting mixture is heated at 210° C. for 30 minutes, and at 250° C. for 30 minutes. The resulting polymer medium is cooled to room temperature to yield magenta copolyester precursor.

In a 2 liter three-necked resin flask equipped with nitrogen inlet and outlet, thermometer, condenser and mechanical dispersing stirrer, are placed 211.8 grams of copolyester precursor as prepared above, 125 grams of Isopar V, 375 grams of Norpar 15, and 21.2 grams of Ganex V-200. The resulting mixture is heated to 220° C. with agitation while recovering ethylene glycol and 2-methyl-1,3-propanediol distillate.

The reaction mixture gradually forms a milky magenta dispersion. After distilling 20 ml of ethylene glycol and 2-methyl-1,3-propanediol, the reaction temperature is maintained at 220° C. for 2 hours. The resulting polymer medium is cooled to 35° C. with agitation. The speed of agitation is maintained at 1000 rpm during the polymerization period. The magenta microspheres of polymer are separated from the reaction media by filtration. The microspheres are washed with chilled hexane. The particle size of the microspheres is about 10 microns as determined by a JSM840F FESEM operating at 5 KV.

The polyester has a weight average molecular weight of about 13,000, a glass transition temperature of 64° C., a melt-viscosity of 675 poises at 150° C., a melt index of 200 grams per 10 minutes under a load of 2.16 kilograms, and a polydispersity of about 2.5.

Figure 2:
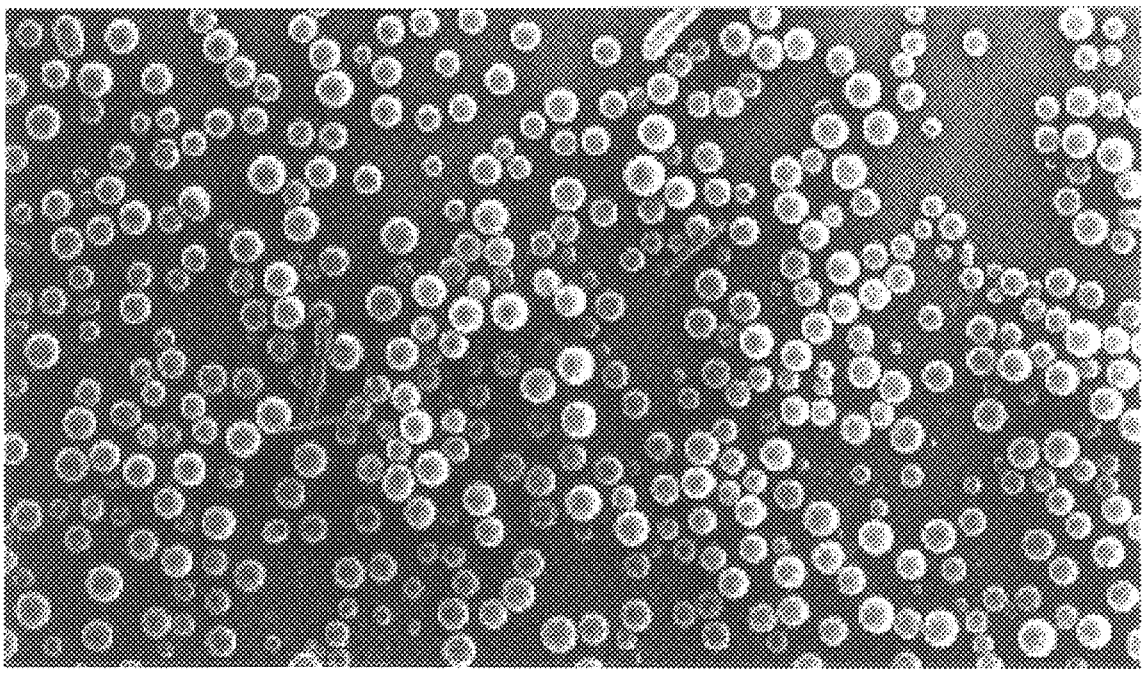
FIG. 2 is a scanning electron microscope (SEM) micrograph of polyester dye microspheres produced by the Example X process.

FIG. 2 is a SEM micrograph of the Example X copolyester dye microspheres.

EXAMPLE XI

Polyester Microspheres of Copolymerized bis(3-hydroxy-2-methylpropyl) Terephthalate, bis(hydroxyethyl) Terephthalate, bis(2-Tetradecyl-2-hydroxyethyl) Terephthalate and 2,2'-[(3,3'-dichloro-1,1'-diphenyl]-4,4'-bis(azo)]-bis[N-(2-methoxyphenyl)]-3-oxobutanamide by Non-Aqueous Dispersion Polymerization

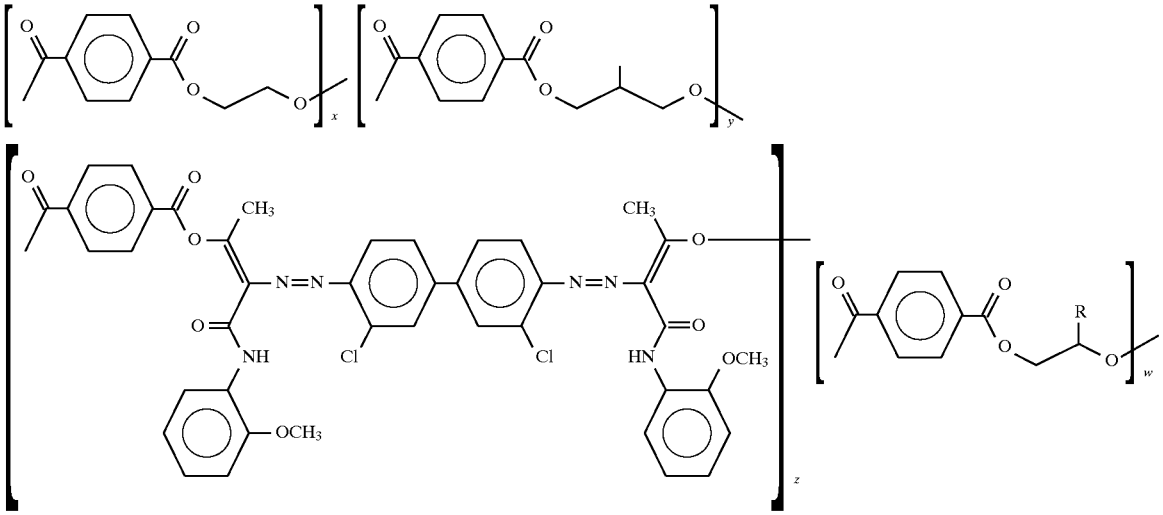

where R is $C_{14}H_{29}$, and x/y/z/w is 62.40/35.00/1.8/0.8 mole percent.

In a one liter three-necked resin flask equipped with nitrogen inlet and outlet, thermometer, condenser and mechanical stirrer, are placed 142.88 grams (0.4604 m) of bis(3-hydroxy-2-methylpropyl) terephthalate, 208.68 grams (0.8208 m) of bis(hydroxyethyl) terephthalate, and 16.69 grams (0.0242 m) of 2,2'-[(3,3'-dichloro-1,1'-diphenyl)-4,4'-bis(azo)]-bis[N-(2-methoxyphenyl)]-3-oxobutanamide (C.I. Pigment Yellow 17), 6.99 grams (0.0108 m) of bis(1-tetradecyl-1-hydroxyethyl) terephthalate, and 0.2 grams of titanium tetraisopropoxide. The resulting mixture is heated at 210° C. for 30 minutes, and at 240° C. for 30 minutes. The resulting polymer medium is cooled to room temperature to yield yellow copolyester precursor.

In a 2 liter three-necked resin flask equipped with nitrogen inlet and outlet, thermometer, condenser and mechanical dispersing stirrer, are placed 211.8 grams of copolyester precursor as prepared above, 125 grams of Isopar V, 375 grams of Norpar 15, and 21.2 grams of Ganex V-200. The resulting mixture is heated to 220° C. with agitation while recovering ethylene glycol and 2-methyl-1,3-propanediol distillate.

The reaction mixture gradually forms a milky yellow dispersion. After distilling 20 ml of ethylene glycol and 2-methyl-1,3-propanediol, the reaction temperature is maintained at 220° C. for 2 hours. The resulting polymer medium is cooled to 35° C. with agitation. The speed of agitation is maintained at 1000 rpm during the polymerization period. The yellow microspheres of polymer are separated from the reaction media by filtration. The microspheres are washed with chilled hexane. The particle size of the microspheres is about 10 microns as determined by a JSM840F FESEM operating at 5 KV.

The polyester has a weight average molecular weight of about 14,000, a glass transition temperature of 54° C., a melt-viscosity of 650 poises at 150° C., a melt index of 210 grams per 10 minutes under a load of 2.16 kilograms, and a polydispersity of about 2.2.

EXAMPLE XII

Polyester Microspheres of Copolymerized bis(3-hydroxy-2-methylpropyl) Terephthalate, bis (hydroxyethyl) terephthalate, bis(2-tetradecyl-2-hydroxyethyl) Terephthalate and 2,2'-[(3,3'-dichloro-1,1'-diphenyl]-4,4'-bis(azo)]-bis[N-(2-methoxyphenyl)]-3-oxobutanamide by Non-Aqueous Dispersion Polymerization

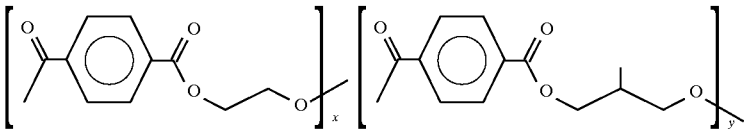

-continued

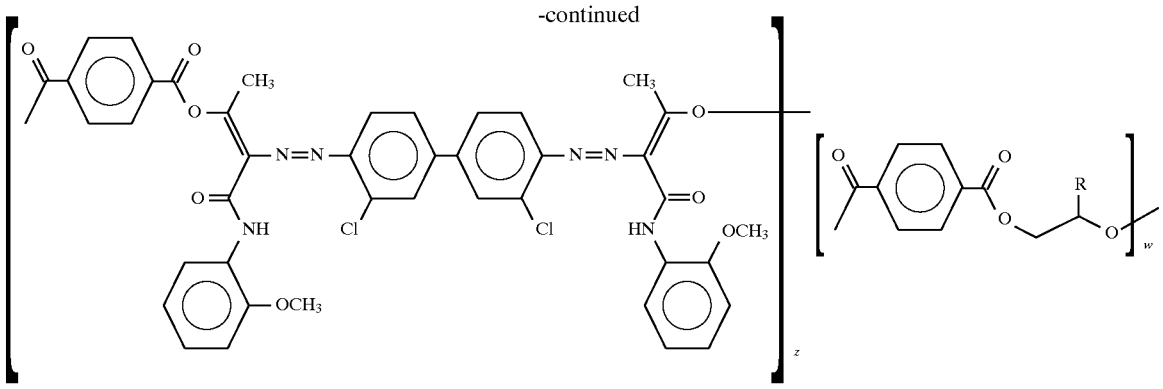

where R is $C_{14}$-$H_{29}$, and x/y/z/w is 48.7/48.7/1.8/0.8 mole percent.

In a one liter three-necked resin flask equipped with nitrogen inlet and outlet, thermometer, condenser and mechanical stirrer, are placed 198.81 grams (0.64 m) of bis(3-hydroxy-2-methylpropyl) terephthalate, 162.87 grams (0.64 m) of bis(hydroxyethyl) terephthalate, and 16.69 grams (0.0242 m) of 2,2'-[(3,3'-dichloro-1,1'-diphenyl]-4,4'-bis(azo)]-bis[N-(2-methoxyphenyl)]-3-oxobutanamide (C.I. Pigment Yellow 17), 6.99 grams (0.0108 m) of bis(1-tetradecyl-1-hydroxyethyl) terephthalate, and 0.2 grams of titanium tetraisopropoxide. The resulting mixture is heated at 210° C. for 30 minutes, and at 240° C. for 30 minutes. The resulting polymer medium is cooled to room temperature to yield yellow copolyester precursor.

In a 2 liter three-necked resin flask equipped with nitrogen inlet and outlet, thermometer, condenser and mechanical dispersing stirrer, are placed 211.8 grams of copolyester precursor as prepared above, 125 grams of Isopar V, 375 grams of Norpar 15, and 21.2 grams of Ganex V-200. The resulting mixture is heated to 220° C. with agitation while recovering ethylene glycol and 2-methyl-1,3-propanediol distillate. The reaction mixture gradually forms a milky yellow dispersion. After distilling 20 ml of ethylene glycol and 2-methyl-1,3-propanediol, the reaction temperature is maintained at 220° C. for 2 hours. The resulting polymer medium is cooled to 35° C. with agitation. The speed of agitation is maintained at 1000 rpm during the polymerization period. The yellow microspheres of polymer are separated from the reaction media by filtration. The microspheres are washed with chilled hexane. The particle size of the microspheres is about 10 microns as determined by a JSM840F FESEM operating at 5 KV.

The polyester has a weight average molecular weight of about 16,000, a glass transition temperature of 55° C., a melt-viscosity of 800 poises at 150° C., a melt index of 150 grams per 10 minutes under a load of 2.16 kilograms, and a polydispersity of about 2.6.

EXAMPLE XIII

Polyester Microspheres of Copolymerized Dimethyl Terephthalate, 1,2-propanediol, bis(2-tetradecyl-2-hydroxyethyl) Terephthalate and 2,2'-[(3,3'-dichloro-1,1'-diphenyl]-4,4'-bis(azo)]-bis[N-(2-methoxyphenyl)]-3-oxobutanamide by Non-Aqueous Dispersion Polymerization

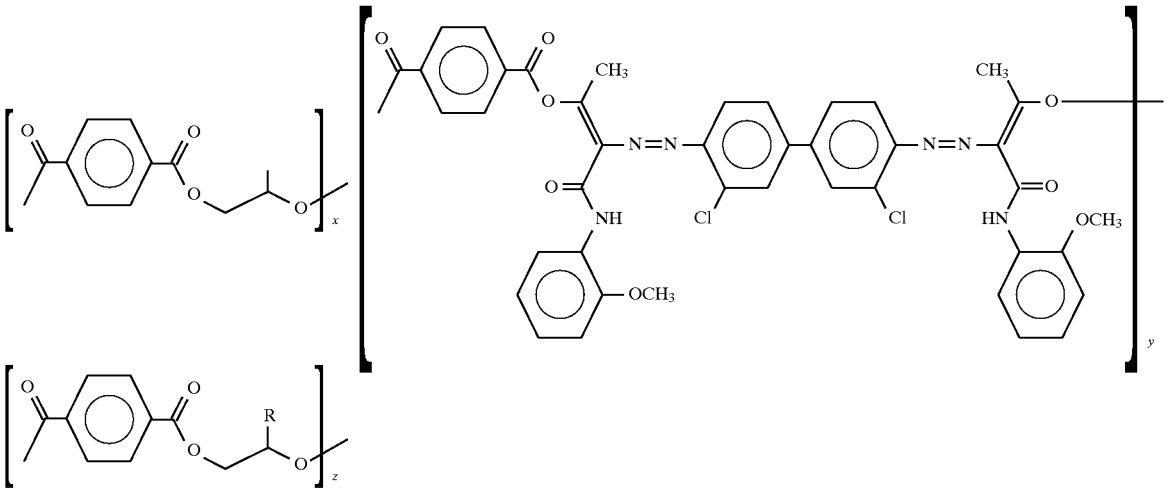

where R is $C_{14}H_{29}$, and x/y/z is 97.4/1.8/0.8 mole percent.

In a one liter three-necked resin flask equipped with nitrogen inlet and outlet, thermometer, condenser and mechanical stirrer, are placed 248.8 grams (1.2812 m) of dimethyl terephthalate, 224.25 grams (2.997 m) of 1,2-propanediol, 16.69 grams (0.0242 m) of 2,2'-[3,3'-dichloro-1,1'-diphenyl]-4,4'-bis(azo)]bis-[N-(2-methoxyphenyl)]-3-oxobutanamide (C.I. Pigment Yellow 17), 6.99 grams (0.0108 m) of bis(1-tetradecyl-1-hydroxyethyl) terephthalate, and 0.2 grams of titanium tetraisopropoxide. The resulting mixture is heated at 210° C. for 30 minutes, and at 240° C. for 30 minutes. The resulting polymer medium is cooled to room temperature to yield yellow copolyester precursor.

In a 2 liter three-necked resin flask equipped with nitrogen inlet and outlet, thermometer, condenser and mechanical dispersing stirrer, are placed 211.8 grams of copolyester precursor as prepared above, 125 grams of Isopar V, 375 grams of Norpar 15, and 21.2 grams of Ganex V-200. The resulting mixture is heated to 220°C. with agitation while recovering 1,2-propanediol distillate. The reaction mixture gradually forms a milky yellow dispersion. After distilling 20 ml of 1,2-propanediol, the reaction temperature is maintained at 220° C. for 2 hours. The resulting polymer medium is cooled to 35° C. with agitation.

The speed of agitation is maintained at 1000 rpm during the polymerization period. The yellow microspheres of polymer are separated from the reaction media by filtration. The microspheres are washed with chilled hexane. The particle size of the microspheres is about 10 microns as determined by a JSM840F FESEM operating at 5 KV.

The polyester has a weight average molecular weight of about 10,000, a glass transition temperature of 70° C., a melt-viscosity of 800 poises at 150° C., a melt index of 160 grams per 10 minutes under a load of 2.16 kilograms, and a polydispersity of about 2.2.

Following the dispersion polymerization procedure described above, similar polyester dye microspheres are obtained when 2,2'-[3,3'-dichloro-1,1'-diphenyl]-4,4'-bis(azo)]-bis[N-(2-methoxy-phenyl)]-3-oxobutanamide is replaced with a chromophoric monomer as listed in Example III.

EXAMPLE XIV

Polyester Microspheres of Copolymerized bis(2-hydroxypropyl) terephthalate, bis(hydroxy-ethyl) Terephthalate, bis(2-tetradecyl-2-hydroxyethyl) Terephthalate and 2,2'-[(3,3'-dichloro-1,1'-diphenyl]-4,4'-bis(azo)]-bis[N-(2-methoxyphenyl)]-3-oxobutanamide by Non-Aqueous Dispersion Polymerization

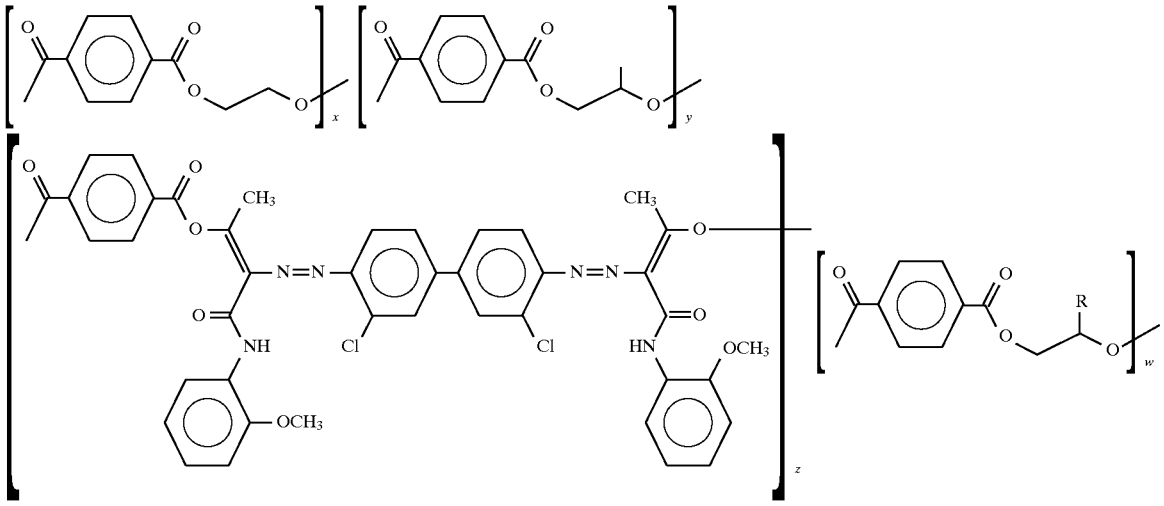

where R is $C_{14}H_{29}$, and x/y/z/w is 37.4/60/1.8/0.8 mole percent.

In a one liter three-necked resin flask equipped with nitrogen inlet and outlet, thermometer, condenser and mechanical stirrer, are placed 222.79 grams (0.7892 m) of bis(2-hydroxy-propyl) terephthalate, 125.08 grams (0.492 m) of bis(hydroxyethyl) terephthalate and 16.69 grams (0.0242 m) of 2,2'-[(3,3'-dichloro-1,1'-diphenyl]-4,4'-bis(azo)]-bis[N-(2-methoxyphenyl)]-3-oxobutanamide (C.I. Pigment Yellow 17), 6.99 grams (0.0108 m) of bis(l-tetradecyl-1-hydroxyethyl) terephthalate, and 0.2 grams of titanium tetraisopropoxide. The resulting mixture is heated at 210° C. for 30 minutes, and at 240° C. for 30 minutes. The resulting polymer medium is cooled to room temperature to yield yellow copolyester precursor.

In a 2 liter three-necked resin flask equipped with nitrogen inlet and outlet, thermometer, condenser and mechanical dispersing stirrer, are placed 211.8 grams of copolyester precursor as prepared above, 125 grams of Isopar V, 375 grams of Norpar 15, and 21.2 grams of Ganex V-200. The resulting mixture is heated to 220° C. with agitation while recovering ethylene glycol and 1,2-propanediol distillate. The reaction mixture gradually forms a milky yellow dispersion. After distilling 20 ml of ethylene glycol and 1,2-propanediol, the reaction temperature is maintained at 220° C. for 2 hours. The resulting polymer medium is cooled to 35° C. with agitation. The speed of agitation is maintained at 1000 rpm during the polymerization period. The yellow microspheres of polymer are separated from the reaction media by filtration. The microspheres are washed with chilled hexane. The particle size of the microspheres is about 10 microns as determined by a JSM840F FESEM operating at 5 KV.

The polyester has a weight average molecular weight of about 11,000, a glass transition temperature of 60° C., a melt-viscosity of 500 poises at 150° C., a melt index of 250 grams per 10 minutes under a load of 2.16 kilograms, and a polydispersity of about 2.1.

Following the dispersion polymerization procedure described above, similar polyester dye microspheres are obtained when 2,2'-[3,3'-dichloro-1,1'-diphenyl]-4,4'-bis(azo)]-bis[N-(2-methoxy-phenyl)]-3-oxobutanamide is replaced with a chromophoric monomer as listed in Example III.

What is claimed is:

1. A toner composition for electrophotographic imaging systems which comprises polyester dye microspheres having an average particle size between about 3–10 microns, and having between about 0.1–20 mole percent of recurring chromophoric diester monomer units, and having a weight average molecular weight between about 5000–100,000, and exhibiting a glass transition temperature ($T_g$) between about 40°–120° C., and a melt-viscosity between about 200–5500 poises at 150° C.

2. A toner composition in accordance with claim 1 wherein the polyester dye has a weight average molecular weight between about 10,000–30,000.

3. A toner composition in accordance with claim 1 which has a polydispersity between about 1.2–4.

4. A toner composition in accordance with claim 1 which exhibits a melt index between about 25–1000 grams per 10 minutes at 150° C. under a load of 2.16 kilograms.

5. A toner composition in accordance with claim 1 which exhibits at least about 80% optical transparency at a specific wavelength within the range between about 350–750 nanometers.

6. A toner composition in accordance with claim 1 wherein the polyester dye comprises copolymerized diol monomer and yellow bis($C_1$–$C_6$ alkyl sebacamide) of 6'-butoxy-2,6-diamino-3,3'-azodipyridine monomer.

7. A toner composition in accordance with claim 1 wherein the polyester dye comprises copolymerized diol monomer and blue bis($C_1$–$C_4$ alkyl sebacamide) of thionine monomer.

8. A toner composition in accordance with claim 1 wherein the polyester dye comprises copolymerized diol monomer and red bis($C_1$–$C_6$ alkyl sebacamide) of basic fuchsin monomer.

9. A toner composition in accordance with claim 1 wherein the polyester dye comprises copolymerized diol monomer and magenta bis($C_1$–$C_6$ alkyl sebacamide) of 3,6-diaminoacridine hydrochloride monomer.

10. A toner composition in accordance with claim 1 wherein the polyester dye comprises copolymerized diol monomer and red bis(methyl eosin) sebacate.

11. A toner composition in accordance with claim 1 wherein the polyester dye comprises copolymerized diol monomer and yellow bis($C_1$–$C_6$ alkyl sebacate) of 4-(4-nitrophenylazo)resorcinol monomer.

12. A toner composition in accordance with claim 1 wherein the polyester dye comprises copolymerized diol monomer and magenta bis($C_1$–$C_6$ alkyl sebacamide) of 2,9-dimethylquinacridone monomer.

13. A toner composition in accordance with claim 1 wherein the polyester dye comprises polymerized yellow bis(3-hydroxy-2-methylpropyl) terephthalate of 2,2'-[(3,3'-dichloro-1,1'-diphenyl)-4,4'-bis(azo)-bis[N-(2-methoxyphenyl)-3-oxobutanamide.

14. A toner composition in accordance with claim 1 wherein the polyester dye comprises copolymerized diol monomer and cyan bis($C_1$–$C_6$ alkyl sabacamide) of 1,4-bis(ethylamino)-9,10-anthraquinone.

15. A toner composition in accordance with claim 1 wherein the polyester dye comprises copolymerized diol monomer and cyan bis($C_1$–$C_6$ alkyl sabacamide) of 1,4-bis-(n-butylamino)-9,10-anthraquinone.

16. A toner composition in accordance with claim 1 wherein the polyester dye comprises copolymerized diol monomer and cyan bis($C_1$–$C_6$ alkyl sabacamide) of 1,4-bis-(4-methylanilino)-9,10-anthraquinone.

17. A toner composition in accordance with claim 1 wherein the polyester dye comprises copolymerized diol monomer and black bis($C_1$–$C_6$ alkyl sabacamide) of 2,3-dihydro-2,2-dimethyl-6-[[4-(phenylazo)-1-naphthylenyl] azo]-1H-perimidine.

18. A toner composition in accordance with claim 1 wherein the polyester dye comprises copolymerized chromophoric diester monomer and terephthalate diol monomer corresponding to the formula:

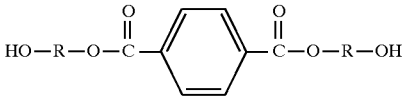

where R is normal or branched-chain $C_3$–$C_{30}$ alkylene.

19. A toner composition in accordance with claim 1 wherein the polyester dye comprises polymerized magenta bis(3-hydroxy-2-methylpropyl) terephthalamide of 2,9-dimethylquinacridone.

20. A toner composition in accordance with claim 1 which includes a liquid developer medium as an additional component.

21. A toner composition in accordance with claim 1 which includes a charge control agent as an additional component.

22. A toner composition in accordance with claim 1 which includes a surfactant as an additional component.

23. A toner composition in accordance with claim 1 which includes a wax ingredient as an additional component.

24. A process for producing a toner composition which comprises polyester dye microspheres having an average particle size between about 3–10 microns, and having between about 0.1–20 mole percent of recurring chromophoric diester monomer units, and having a weight average molecular weight between about 5000–100,000, and exhibiting a glass transition temperature ($T_g$) between about 40°–120° C., and a melt-viscosity between about 200–5500 poises at 150° C., which process comprises copolymerizing a dispersed insoluble phase of diol monomer and chromophoric diester monomer in a liquid organic medium in the presence of a nonionic surfactant at a temperature between about 100°–280° C. with high shear mixing, and separating the formed polyester dye microspheres from the liquid organic medium.

25. A process in accordance with claim 24 wherein the diol monomer corresponds to the formula:

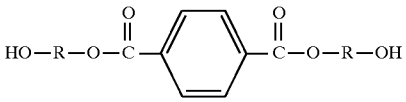

where R is normal or branched chain $C_3$–$C_{30}$ alkylene.

26. A process in accordance with claim 24 wherein the chromophoric diester monomer corresponds to the formula:

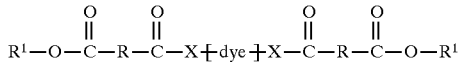

where X is —O— or —NH—; R is a covalent bond or a divalent $C_1$–$C_{16}$ aliphatic, alicyclic or aromatic radical; and $R^1$ is a $C_1$–$C_6$ aliphatic radical.

27. A process in accordance with claim 24 wherein the chromophoric diester monomer corresponds to the formula:

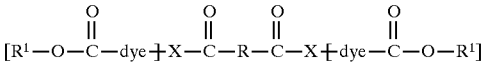

where X is —O— or —NH—; and R is a covalent bond or a divalent $C_1$–$C_{16}$ aliphatic, alicyclic or aromatic radical; and $R^1$ is a $C_1$–$C_6$ aliphatic radical.

28. A process in accordance with claim 24 wherein the surfactant comprises an oxyalkylated $C_{10}$–$C_{16}$ fatty alcohol.

29. A process in accordance with claim 24 wherein the surfactant comprises a vinylpyrrolidone/alkene copolymer.

30. A process in accordance with claim 24 wherein the organic medium comprises a solvent selected from the group consisting of normal paraffins, branched-chain paraffins, naphthenes, aromatic hydrocarbons, and oxygenated derivatives thereof.

31. A process in accordance with claim 24 wherein the copolymerization is conducted for a reaction period between about 0.5–5 hours.

32. A process in accordance with claim 24 wherein the high shear mixing is by stirrer means at a speed between about 500–10,000 rpm.

* * * * *